United States Patent [19]

Moyer

[11] 4,192,248

[45] Mar. 11, 1980

[54] SCOOPED BOAT HULL HAVING TRI-KEEL SURFACES

[76] Inventor: Richard D. Moyer, 45 Ardmore Ave., Hermosa Beach, Calif. 90254

[21] Appl. No.: 871,533

[22] Filed: Jan. 23, 1978

[51] Int. Cl.[2] ..... B63B 1/06

[52] U.S. Cl. ..... 114/56; 114/62; 114/288

[58] Field of Search ..... 114/56, 61, 62, 288, 114/290, 291, 67 R, 67 A, 292; 9/6 R; D12/62

[56] References Cited

U.S. PATENT DOCUMENTS

| | | | |
|---|---|---|---|
| 1,898,876 | 2/1933 | Heljesson | 114/290 |
| 3,077,851 | 2/1963 | Bamberger | 114/62 |
| 3,208,421 | 9/1965 | Landes et al. | 114/292 X |
| 3,807,337 | 4/1974 | English et al. | 114/61 X |
| 3,884,171 | 5/1975 | Kline | 114/62 |
| 3,937,164 | 2/1976 | Austin | 114/288 |
| 3,996,869 | 12/1976 | Hadley | 114/290 |
| 4,002,131 | 1/1977 | Mangrum | 114/56 |
| 4,091,761 | 5/1978 | Fehn | 114/61 X |

*Primary Examiner*—Charles E. Frankfort
*Assistant Examiner*—Winston H. Douglas
*Attorney, Agent, or Firm*—Mahoney, Schick & Cislo

[57] ABSTRACT

A boat hull having a bow and stern and requiring relatively small draft, having low frictional drag characteristics for high speed, stable performance, wherein the hull has a scooped configuration and defines a tri-keel design, wherein the side and bottom walls, making up the hull, define a first, open scoop portion and a second primary keel portion. The open scoop protion is of concave, curvilinear configuration and extends to a point rearwardly of the mid-point of the hull where it merges into the second or primary keel portion. The bottom and side walls of primary keel portion are V-shaped in configuration to thereby define the primary keel which extends from the merging surface to the stern. The first and second portions also cooperatively define about co-extensively therewith, extending from the open scoop portion, a pair of spaced apart secondary keels which extend from the approximate box of the hull to the stern thereof. The side walls define, upwardly spaced from the secondary keel portions, chine means extending from about the bow to the stern of the hull.

10 Claims, 10 Drawing Figures

SCOOPED BOAT HULL HAVING TRI-KEEL SURFACES

BACKGROUND OF THE INVENTION

The invention pertains to a ship or boat hull which is uniquely configured and has attributes which boat hulls of previous design have not been able to attain. While the prior art has recognized to a certain extent the desirability of having hull designs to achieve end results, as for example, as may be found in U.S. Pat. Nos. 3,996,869 and 3,800,725, the ship or boat hull design of this invention provides a water craft which has relatively small draft and which has low frictional drag characteristics so as to provide high speed, stable performance.

The hull of the instant invention has applicability not only to pleasure water craft but also water craft of a military nature. The hull of the instant invention permits relatively shallow draft with a relatively long hull length and a relatively wide hull beam, all while achieving high water velocities, which would not normally be expected considering the conventional power needs of a similarly-sized craft.

The hull design is capable of being constructed in the conventional rib and stringer mode or in the molded mode and is universal with respect to its power requirements. The craft may be powered by inboard or outboard power sources and may even be powered by water jet or conventional jet engines.

Water craft using the hull design of the instant invention will be capable of high speeds, will use significantly less power than other craft of its size and type and because of its unique configuration will require, in the ordinary case, low draft requirements. The hull design permits unusually high maneuverable characteristics and stable performance at high speeds and also allows the craft to turn within its own length. The hull design also permits the adaptation of various types of super structure to the hull whether it be a cabin for pleasure craft or specialized super structure of the type that may be found in naval craft of the torpedo-boat variety. The hull design also permits the craft to ride relatively high in the water thereby leaving a minimum amount of surface to be wetted by the water so as to decrease the amount of frictional drag created by the hull, as the water craft is being propelled through a body of water.

Thus the hull of the instant invention provides all the aforementioned advantages which the prior art has not been able to provide in the mode and manner as proposed by the instant invention.

In the hull of the instant invention, the open scoop forward portion of the hull is such that a cushion of air and water is provided, such that the main body of water that the craft is moving through will break at the main keel portion of the hull, which is located rearward of the mid-point of the hull.

OBJECTS AND SUMMARY OF THE INVENTION

It is an object of the invention to provide a hull which is capable of adaptation to water craft of various types.

It is another object of the invention to provide a hull for water craft which requires little water depth in which to operate.

It is another, still more important object of the invention to provide a hull which uses relatively little wetted surface area.

It is another, still more important, specific object of the invention to provide a hull which may be used with pleasure or military craft.

It is still another, even more specific and more important object of the invention to provide a hull for water craft which is of open-scoop design and which is of tri-keel character.

It is another, still further, more important and specific object of the invention to provide a hull with a unique configuration having an open-scoop, fore portion extending into and merging with a rearward primary keel portion, wherein secondary keel portions are formed to thereby provide high velocity and stability to water craft.

It is still another, more specific and even further object of the invention to provide a hull design utilizing an open-scoop configuration of concave, curvilinear configuration which extends from the approximate bow of the boat to a merging surface located rearwardly of the mid portion of the hull and extending into the main V-shaped keel portion therefrom to the stern of the hull.

It is still another, more specific and more important object of the invention to provide a hull design which permits a water craft to be more rapidly powered through a body of water than conventional craft would be, using the same power source.

It is another, even more specific and further object of the invention to provide a unique hull for use with water craft wherein the water craft has low draft requirements, is of a relatively low wetted surface area to thereby achieve high velocity and wherein the craft rides high in the water under full power or at rest wherein the hull is relatively easily manufactured.

An exemplary embodiment of the invention pertains to a boat hull of relatively small draft having low frictional drag characteristics for high speed stable performance. The hull comprises a pair of spaced apart, side walls and interconnected transom and bottom walls forming a bow and stern. The side and bottom walls define a first open-scoop portion and a second primary keel portion, said open-scoop portion being of non-planar surface and of concave, curvilinear configuration commencing at said bow and extending rearwardly to a merging surface rearward of the mid-point of said hull. Said open-scoop portion is deepest at said bow and diminishes rearward to said merging surface and said second, primary keel portion. Said second, primary keel portion is V-shaped in configuration and defines a primary keel extending from said merging surface to said stern. The open-scoop portion and primary, keel portion cooperatively define, rearwardly of the opening of said scoop portion, a pair of spaced secondary keels extending about, the length of said hull from about said bow to said stern. Chine means spaced from each of said secondary keels and extending the length thereof completes the essential component parts or portions of the boat hull of the invention.

These and further objects of the invention will become apparent from the hereinafter following commentary taken in conjunction with the figures of drawing.

DESCRIPTION OF THE BEST EMBODIMENTS CONTEMPLATED

Figure 1:
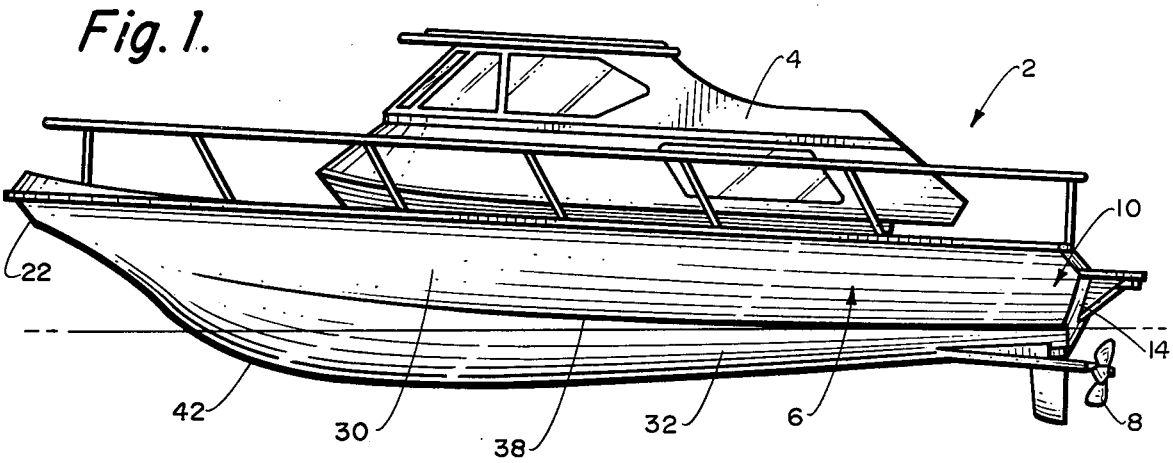
FIG. 1 is a side, elevational view of a typical pleasure craft employing the hull of the invention.

While the hull design of the invention will be described as it would normally apply to water craft of the pleasure variety, it should be understood that the hull design of the invention also has military application. Additionally, while the hull design is indicated as being of molded construction of the ubiquitous type found in fiberglass boats and indeed may be constructed of fiberglass, it is to be understood that the hull may be made in the conventional manner using ribs and stringers whether of wood or metal and it may also be fabricated using typical, military ship construction techniques to provide a military craft fulfilling selected needs and requirements.

The hull of the instant invention will also be described, as is seen in the figures of drawing, for pleasure craft of a size which should not be delimiting to the practice of the invention in that the hull design may be applicable to boats and/or ships of varying lengths and beams. For example, the craft depicted in the figures of drawings is approximately 41 feet in length and has a 16 foot beam at its widest portion. The craft shown has a 1 foot draft requirement and weighs between 12–15 tons. When powered by two 454 horsepower gasoline engines with a rating of 350 HP at 4500 rpm using a 1:1 gear ratio and a 16 inch propeller, a cruising speed of approximately 33 mph at 3,300 rpm was attained. With an equivalent sized conventional and ordinary pleasure craft, using the same horsepower, the maximum speed of such craft normally expected would be in the 16–17 mph range. Thus as can be seen, the speed of the craft utilizing the unique hull design of the invention was increased almost 100 percent. Thus, keeping the foregoing in mind the invention will be described as it applies to the pleasure craft shown in the drawings, it being understood that the hull of the invention has applicability other than as specifically described and shown.

Figure 2:
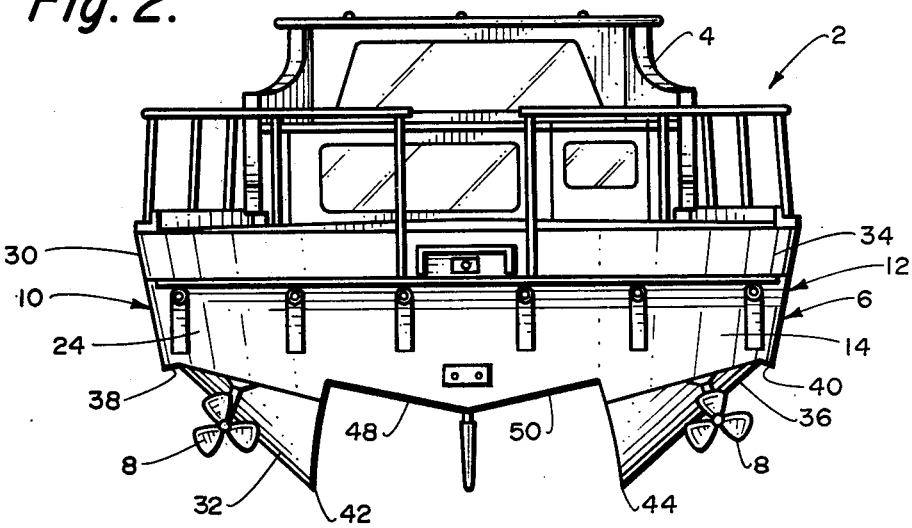
FIG. 2 is a rear view of the craft depicted in FIG. 1.
Figure 10:
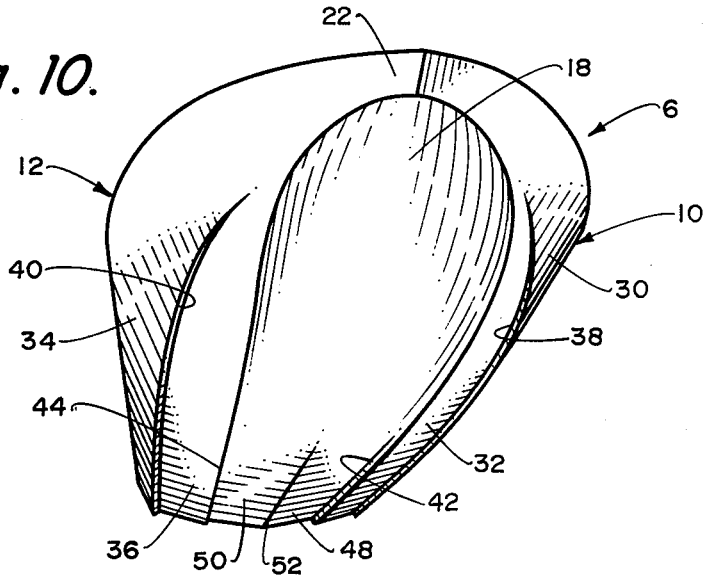
FIG. 10 is a front, perspective view of the hull of the invention.
Figure 3:
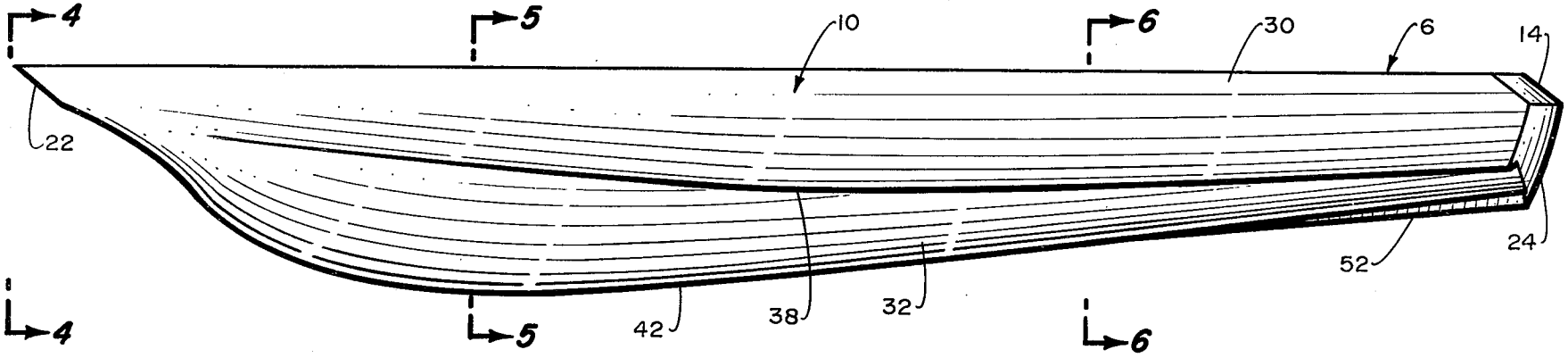
FIG. 3 is a side view of the hull of the invention alone which may have any type of super structure associated therewith.
Figure 6:
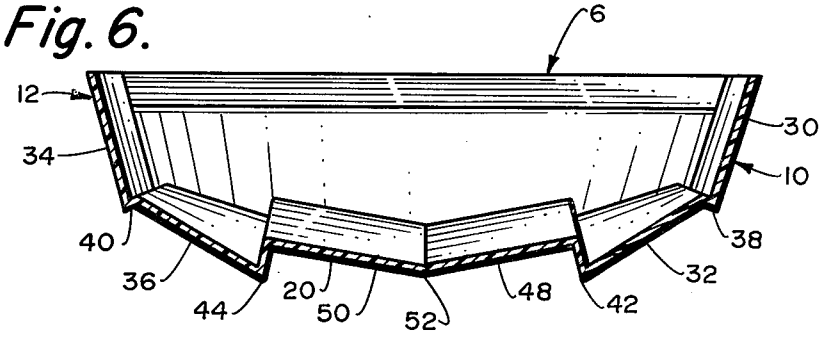
FIG. 6 is a cross-sectional view taken along the line 6—6 of FIG. 3.
Figure 5:
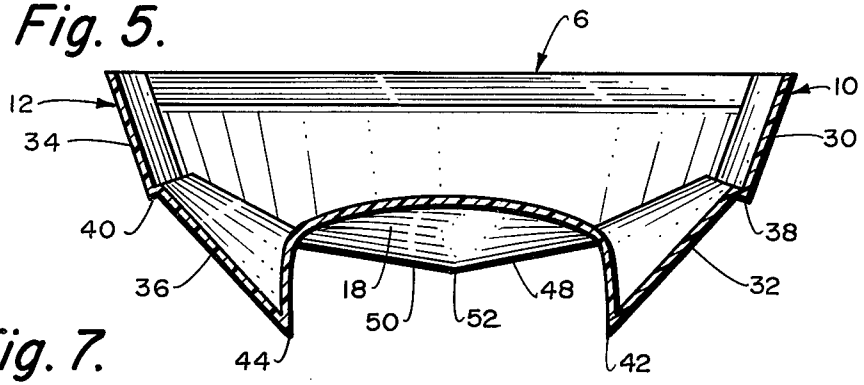
FIG. 5 is a cross-sectional view taken along the line of 5—5 of FIG. 3.
Figure 7:
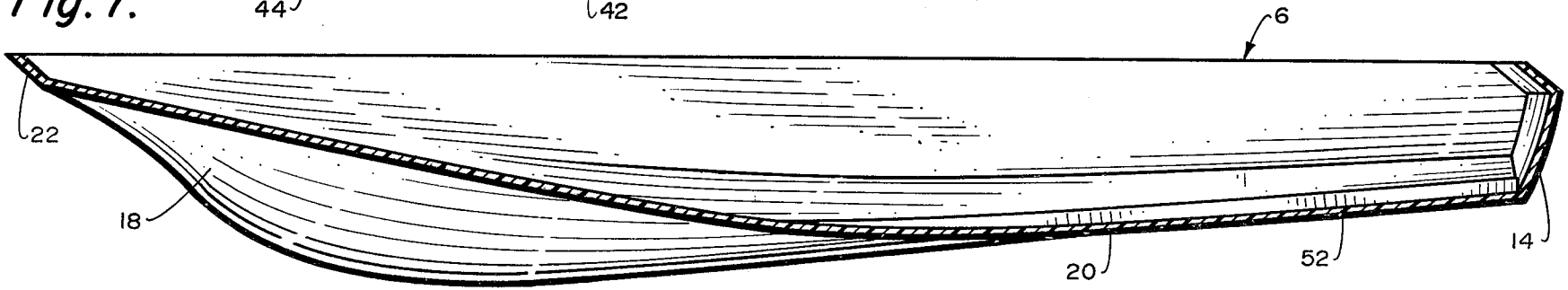
FIG. 7 is a cross-sectional view taken along the line 7—7 of FIG. 4.
Figure 4:
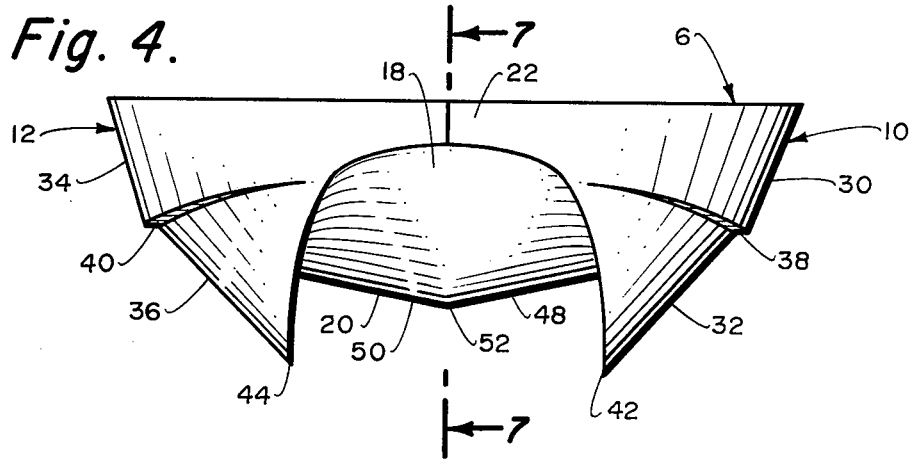
FIG. 4 is a front view taken along the line 4—4 of FIG. 3.
Figure 8:
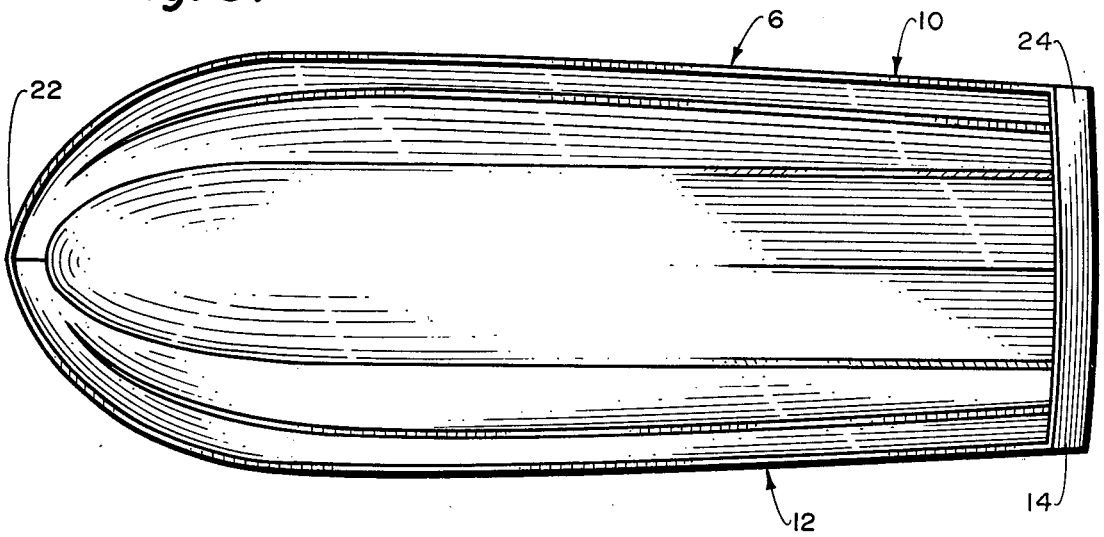
FIG. 8 is a top view of the hull depicted in FIG. 3.

Referring to the figures of drawings wherein like numerals of reference designate like elements throughout, and referring specifically to FIGS. 1 and 2 it will be noted that the pleasure craft 2 has a conventional super struture 4 and hull 6 of the invention. In this particular instance, the pleasure craft 2 is provided with an inboard power source comprising twin engines (not shown) driving twin propellers 8. The boat 2 has actually been built and the foregoing data relates to such a craft as depicted in FIGS. 1 and 2.

Referring now to the remaining figures, the specific attributes of the invention will now be described as are imparted by reason of the configuration of hull 6.

Hull 6 comprises spaced, side walls generally indicated at 10 and 12 with an inter-connected transom wall 14 and a bottom wall 16. The hull 6 is formed of an open scoop portion 18 having a concave, curvilinear configuration and having its deepest portion at its approximate opening and diminishing rearwardly where it merges with a second, primary keel portion 20.

Figure 9:
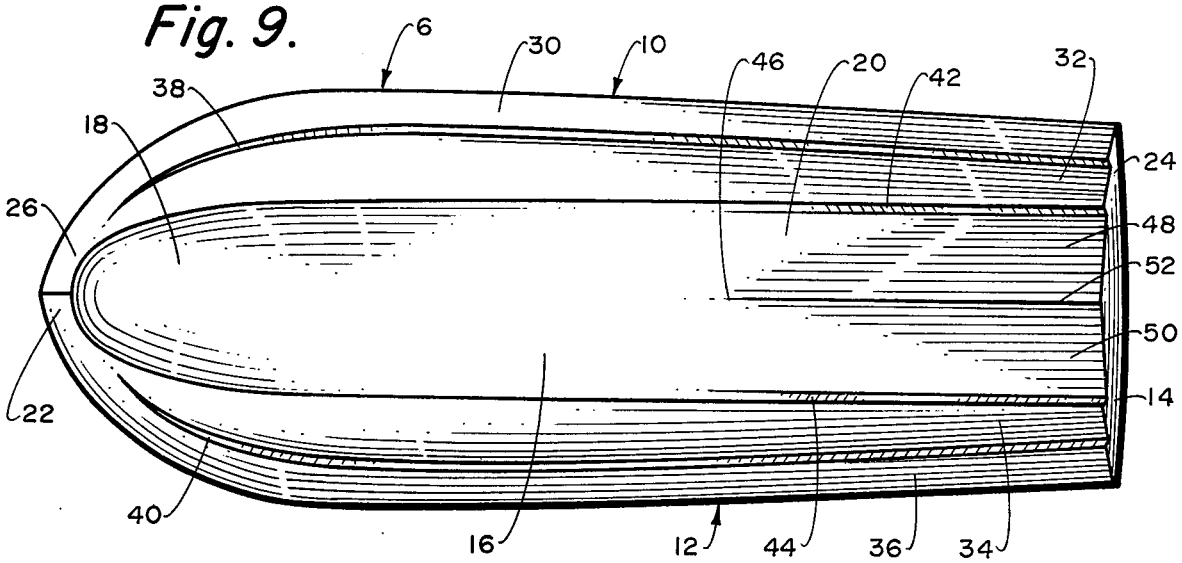
FIG. 9 is a bottom view of the hull depicted in FIG. 3.

The side, transom and bottom walls of hull 6 form bow 22 and stern 24. It will be noted that the open scoop or first portion 18 forms a lip 26 best seen in FIG. 9.

It should of course be noted that a deck, super structure or interior bulkheads are not shown for purposes of clarity in the various figures of drawings of the hull 6 of the invention.

The bottom and side walls, 16 and 10 and 12 respectively, co-act to define there-between the two sections of the hull 18 and 20. The side wall 10 comprises a first or upper, freeboard wall portion 30 and a lower, side bottom wall 32. Likewise the side wall 12 is formed of the upper, freeboard side portion 34 and having therebeneath side wall, bottom wall portion 36. It should be noted that the side walls 10 and 12 are planar and are of flat configuration.

At the intersection of the free, side walls 30, 34 and the lower side, wall bottom walls 32, 36 respectively, there are formed chine means 38 and 40 in each side of hull 6 forming a water way for breaking water as will become apparent. It will be noted that the chine means or water ways 38 and 40 merge from the bow 22 of hull 6 and extend to the stern 24.

The chines 38 and 40 are spaced upwardly from secondary keels 42 and 44, which in the forward or bow portion of hull 6 are formed by reason of the configuration of open scoop portion 18 and in the rearward portion of hull 6 are formed by reason of the primary keel portion 20. It will be noted that the secondary keels 42 and 44 extend from the approximate bow portion 22, adjacent and coextensive with the scoop of the hull 6 and diminish in depth or height as the depth or height of the scoop portion 18 gradually diminishes rearwardly until reaching the surface at about the point 46, rearward of the mid portion of the hull 6, merging into the primary, keel portion 20. The primary, keel portion 20 by V-shaped walls 48 and 50 forming at the intersection thereof primary keel 52 and defining at the opposite side edge the continuation of secondary keels 42 and 44 extending from the bow 22 to the stern 24 of hull 6. The bottom wall portions 48 and 50 of primary keel portion 20 are planar as are the side walls 10 and 12 of hull 6.

It will be noted that the transom wall 14 extends outwardly, and non-vertically from the bottom walls 48 and 50 of primary keel portion 20 and the stern 14 is curvilinear as opposed to being square. It should also be noted that the hull 6 has a narrowed or diminished bow 22, reaches a maximum beam just slightly rearwardly of bow 22 and then diminishes in a gradual curvilinear manner to the stern 14.

The open-scoop portion 18, of hull 6, diminishes rearwardly in concave height and merges into the primary, keel portion 20 rearward of the mid portion of the hull 6, thereby providing a hull 6 which rides relatively high in the water, when the boat, with which the hull 6 is utilized, is at rest or is being propelled through the water at a relatively high velocity. The tri-keel effect formed by the secondary keels 42 and 44 along with the primary keel 52 provides a water craft utilizing a hull 6, which has relatively high stability at the high velocities attained.

When being propelled through the water at high speeds it is believed that the open-scoop portion 18 acts in a manner to provide a cushion of water droplets and air bubbles beneath the hull 6 in the open-scoop portion 18 of the hull and the main water surface is not broken until the approximate primary keel portion 20 of hull 6. This provides not only a minimum amount of water, wetted hull surface but also provides for stable and constant riding of the boat hull over a body of water in which it is immersed.

Thus, there has been described a hull design which may be utilized with both pleasure and military craft and which is capable of attaining high velocity at stable conditions so as to obviate a rough or slapping ride due to the boat hull encountering bow water as it moves through a body of water.

While the invention has been described with respect to specific particulars, those of ordinary skill in the art will at once recognize the attributes of the invention and while various changes and modifications will suggest themselves, these changes and modifications will not depart from the essence of the invention and all are intended to be covered by the appended claims.

I claim:

1. A boat hull of relatively small draft, having low frictional drag characteristics for high speed, stable performance, said hull comprising a pair of spaced-apart side walls, and interconnected transom and bottom walls forming a bow and stern, said side and bottom walls defining an open-scoop portion and a primary keel portion, said open-scoop portion being of non-planar surface and of concave, curvilinear configuration commencing at said bow and extending rearwardly to a merging surface rearward of the mid-point of said hull, said open-scoop portion being deepest at said bow and diminishing rearwardly in concave height to said merging surface and said primary keel portion, said primary keel portion being V-shaped in configuration and defining a primary keel extending from said merging surface to said stern, said open-scoop portion and said primary keel portion defining rearward of the opening of said scoop portion, a pair of spaced, secondary keels extending the length of said hull from said bow to said stern; and chine means spaced from each of said secondary keels extending about the length thereof.

2. The hull in accordance with claim 1 wherein said chine means are formed by intersecting side wall portions.

3. The hull in accordance with claim 2 wherein the configuration of said hull is of tapering design from a point just rearward of said bow to said stern.

4. The hull in accordance with claim 1 wherein said side walls are planar, in cross-section, at any point along said hull.

5. The hull in accordance with claim 1 wherein said side walls are formed of a first, side wall portion from the freeboard thereof being inwardly directed and intersecting a second, lower side wall bottom wall portion innerset from said first, side wall portion and the intersecting surface thereby formed defines said chine means.

6. The hull in accordance with claim 5 wherein said transom wall is curvilinear.

7. The hull in accordance with claim 1 wherein said open-scoop portion defines a lip with said bow.

8. The hull in accordance with claim 7 wherein the mouth opening of said open-scoop portion is spherical in configuration.

9. The hull in accordance with claim 8 wherein said chine means merge with said hull at about the bow thereof.

10. The hull in accordance with claim 9 wherein said transom wall extends in a non-vertical relationship with respect to said side and bottom walls and which includes a super structure of the pleasure craft variety.

* * * * *